US005143283A

United States Patent [19]

Lancaster

[11] Patent Number: 5,143,283

[45] Date of Patent: Sep. 1, 1992

[54] REINFORCED CONTAINER FOR LARGE OBJECTS

[75] Inventor: Gary D. Lancaster, Lewisburg, Tenn.

[73] Assignee: The Mead Corporation, Dayton, Ohio

[21] Appl. No.: 684,707

[22] Filed: Apr. 12, 1991

[51] Int. Cl.[5] ..... B65D 5/42

[52] U.S. Cl. ..... 229/199; 206/335; 206/320; 220/651

[58] Field of Search ..... 229/199, 23 C, 198.2; 220/400, 401, 651, 652, 653; 206/320, 335, 521; 217/65; 108/35; 312/265.4, 260

[56] References Cited

U.S. PATENT DOCUMENTS

| | | | |
|---|---|---|---|
| 1,585,684 | 3/1926 | Oppenheim . | |
| 2,013,346 | 9/1935 | Gomes . | |
| 2,254,381 | 9/1941 | Mueller | 229/23 C |
| 2,483,481 | 10/1949 | Stetson | 229/199 |
| 2,753,101 | 7/1956 | Zimmerman . | |
| 2,804,253 | 8/1957 | Brandt | 229/23 C |
| 3,162,351 | 12/1964 | Rudofski . | |
| 3,648,920 | 3/1972 | Stump | 229/199 |
| 3,835,986 | 9/1974 | Le Beau | 217/65 |
| 4,171,741 | 10/1979 | Fish | 229/23 C |
| 4,356,925 | 11/1982 | Gerhard | 220/401 |
| 4,360,287 | 11/1982 | Larsson et al. | 217/65 |
| 4,832,256 | 5/1989 | Grigsby | 229/23 C |

FOREIGN PATENT DOCUMENTS 721103 12/1954 United Kingdom .

*Primary Examiner*—Stephen Marcus
*Assistant Examiner*—Christopher McDonald

[57] ABSTRACT

A reinforced container for use in packing and shipping a large object is disclosed. The container includes a framework and a covering fitted around the framework. The framework includes a bottom latticework for supporting the object to be packed, a top latticework disposed substantially parallel to the bottom latticework to define a space for the object between the latticeworks, and spaced parallel posts extending and interposed between the latticeworks to maintain the space for the object. Each of the post members has upper and lower end portions separably engaged respectively with the top and bottom latticeworks to maintain the post members erected in positions between the latticeworks. The latticeworks and the posts are not fixedly connected to each other. The covering, however, holds the latticeworks and the posts together in assembled condition.

19 Claims, 4 Drawing Sheets

REINFORCED CONTAINER FOR LARGE OBJECTS

BACKGROUND OF THE INVENTION

The present invention relates to a reinforced container designed for use in packing and shipping large objects such as riding lawn mowers, air conditioners, washing machines, water heaters or the like. More particularly, the present invention relates to a container which includes an inner framework and a covering for the framework. The framework includes top and bottom latticeworks and post members extending between the latticeworks. The post members are not fixedly connected to the latticeworks. The covering, however, holds the framework in assembled condition.

Known containers for use in shipping large and heavy objects generally include a paperboard casing with an inner wooden framework. The wooden framework, typically, is assembled inside the casing using nails, screws or the like during the packing process. This assembling process is laborious and time consuming; besides, containers of this type are difficult to open. However, wooden frameworks are still popular since they ensure mechanical strength sufficient to protect the contents. Assembling sturdy containers is especially important when containers encase heavy objects and particularly when containers are stacked to considerable height during storage or transportation.

U.S. Pat. No. 3,162,351 to Rudofski discloses a shipping container including integral corner posts for providing stacking strength. This container is designed for use as an outer cover for a liquid filled plastic bag, and thus is not appropriate for packing a large and heavy object which requires good rigidity also in the top and bottom wall areas. The container of this patent merely has layers of corrugated paperboard as the top and bottom walls which are not strong enough to bear an applied compressive load when containers of this type are stacked.

Forming or attaching bulky reinforcement on the internal face of a casing is impractical because it would make the casing difficult to fold in collapsed fashion to perform economical "knock down" shipment prior to use. Collapsible integral reinforcement such as the integral corner posts in the above-mentioned patent can be available only at certain positions in a container.

What is needed, therefore, is a container for use in shipping large objects. Such a container should be sturdy and easy to assemble and also should permit "knock down" shipment.

SUMMARY OF THE INVENTION

The present invention provides a reinforced container for use in packing and shipping a large object. The container includes a framework and a covering fitted around the framework.

The framework includes top and bottom latticeworks and post members. The bottom latticework is designed for supporting a large object. The top latticework is disposed substantially parallel to the bottom latticework to define a space for the object between the latticeworks. The post members are extended and interposed between the latticeworks in a spaced parallel relationship to maintain the space for the object. The upper and lower end portions of each post member are separably engaged respectively with the top and bottom latticeworks to maintain the post members erected in positions between the latticeworks.

The latticeworks and the post members are not fixedly connected with each other, and thus the container is easy to assemble and disassemble. Although the framework is not nailed or screwed, the covering holds the latticeworks and the post members together in assembled condition.

When packed, large objects having irregular configuration, such as riding lawn mowers, leave some dead space in the container. Such objects, therefore, do not contribute to the mechanical strength of the container. The latticeworks and the post members, however, resist the compressive load applied to the container when containers of this type are stacked one on top of one another. The engagement of the post members with the latticeworks maintains the post members erected in their positions against rough handling or vibration during transportation.

In accordance with an embodiment of the present invention, each latticework is formed of an array of longitudinal skeleton elements intersecting an array of transverse skeleton elements. A securing sheet is laminated onto at least some portion of one of the opposite sides of each latticework to interconnect and hold the associated skeleton elements together. The skeleton elements may be of a tubular configuration. These tubular elements result in reduction of the weight of the container, which, in turn, reduces labor in the assembling process and the cost of transportation. When the framework is formed of paper tubes, it is easy to discard or recycle subsequent to use.

The present invention also provides a method of packing a large object in the above-mentioned container. Accordingly, an object of the present invention is to provide a reinforced container which is quick and easy to assemble and unpack.

Another object of the present invention is to provide a reinforced container which provides stacking strength sufficient to protect the content when stacked under other containers.

Still another object of the present invention is to provide a reinforced container which is of a collapsible construction to permit "knock down" shipment.

A further object of the present invention is to provide a lightweight container which is convenient to handle and to transport.

A further object of the present invention is to provide a reinforced container which is convenient to recycle.

Other objects and and advantages of the present invention will be apparent from the following description, the accompanying drawings and the appended claims.

DETAILED DESCRIPTION OF THE PREFERRED EMBODIMENT

Figure 1:
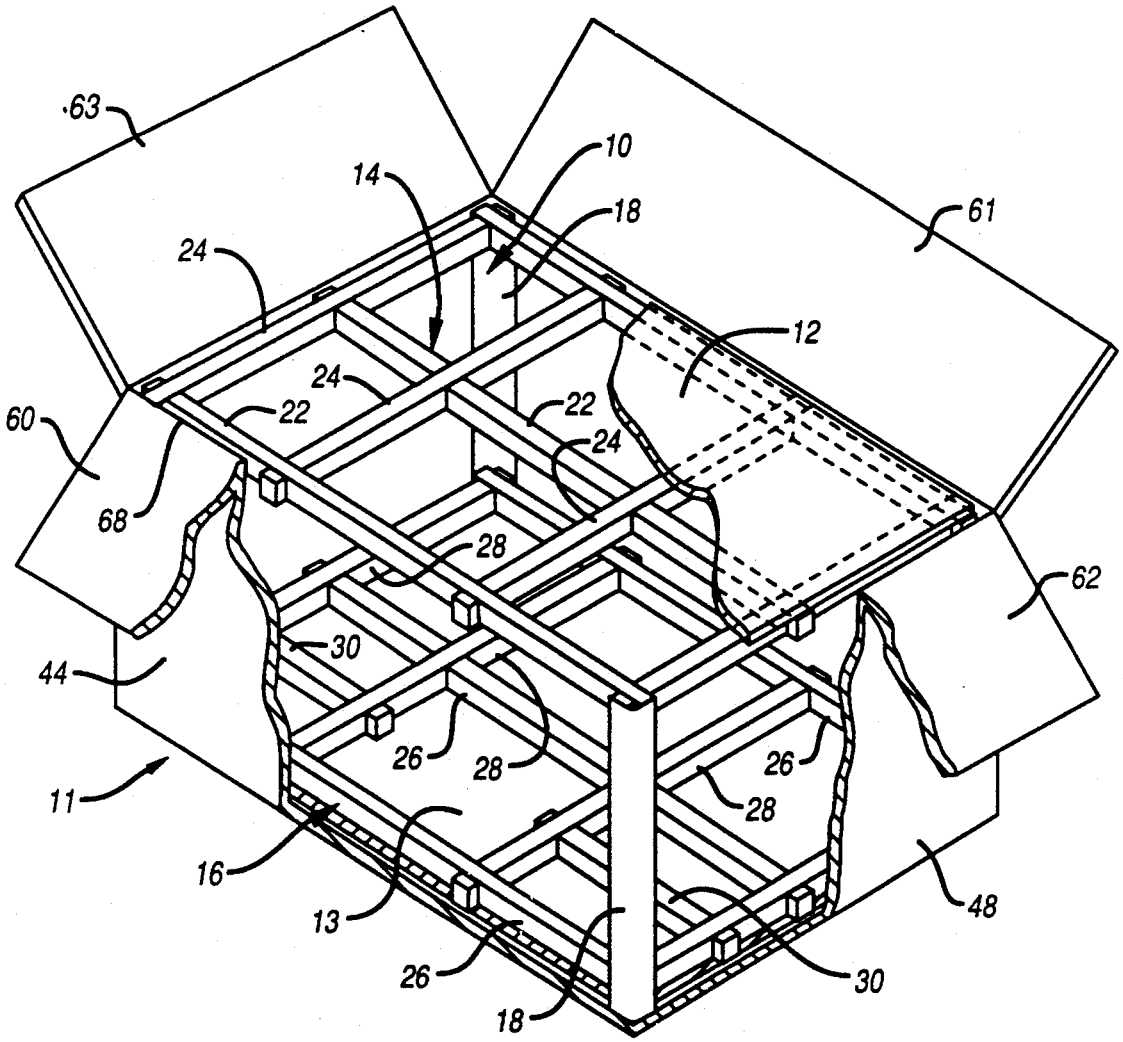
FIG. 1 is a perspective view, partly cut away, of a reinforced container according to the present invention.
Figure 2:
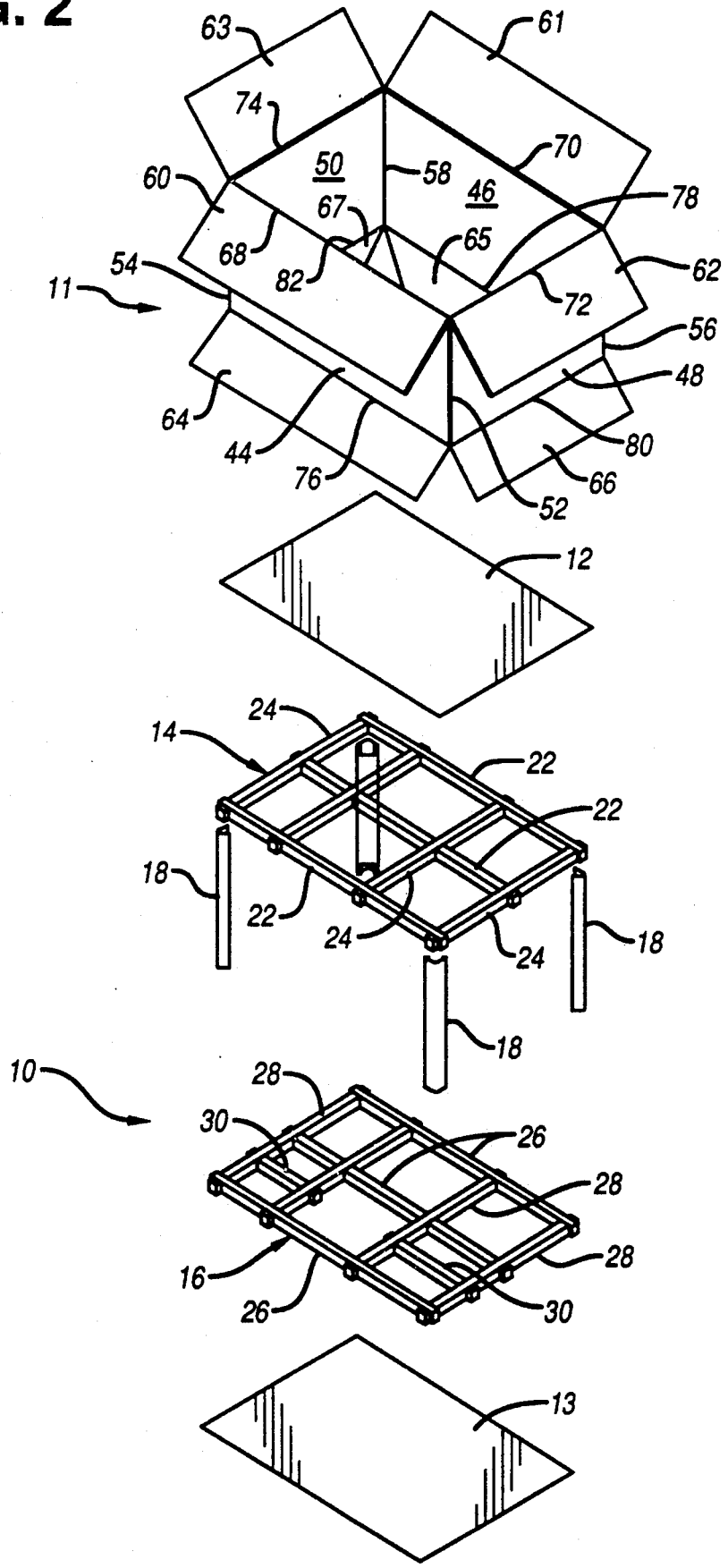
FIG. 2 is an exploded perspective view of the reinforced container in FIG. 1.

FIGS. 1 to 5 illustrate an embodiment of the present invention, where FIGS. 1 and 2 show a reinforced container designed for packing and shipping a large and heavy object such as a riding lawn mower. The container includes a framework 10, a covering in the form of a paperboard box or casing 11, and paperboard sheets 12 and 13.

As illustrated in FIG. 1, the framework 10 defines a space in which a large object may be received. This framework 10 is composed of vertically spaced parallel top and bottom latticeworks 14 and 16 and corner posts 18 interposed and extending between the latticeworks 14 and 16 in a laterally spaced parallel fashion. The top and bottom latticeworks 14 and 16 may have any desired shape or design but are preferably of a rectangular periphery (see FIG. 2).

The bottom latticework 16 is designed to support the object to be received in the container. The corner posts 18 are engaged at their lower end portions respectively with the corners of the bottom latticework 16 and are extended upward. The top latticework 14 rests on the upper ends of the corner posts 18 and is engaged at its corners respectively with the upper end portions of the corner posts. The top and bottom latticeworks 14 and 16 and the corner posts 18 are not fixedly joined to one another but are held in assembled condition as will be described later in more detail.

Figure 3:
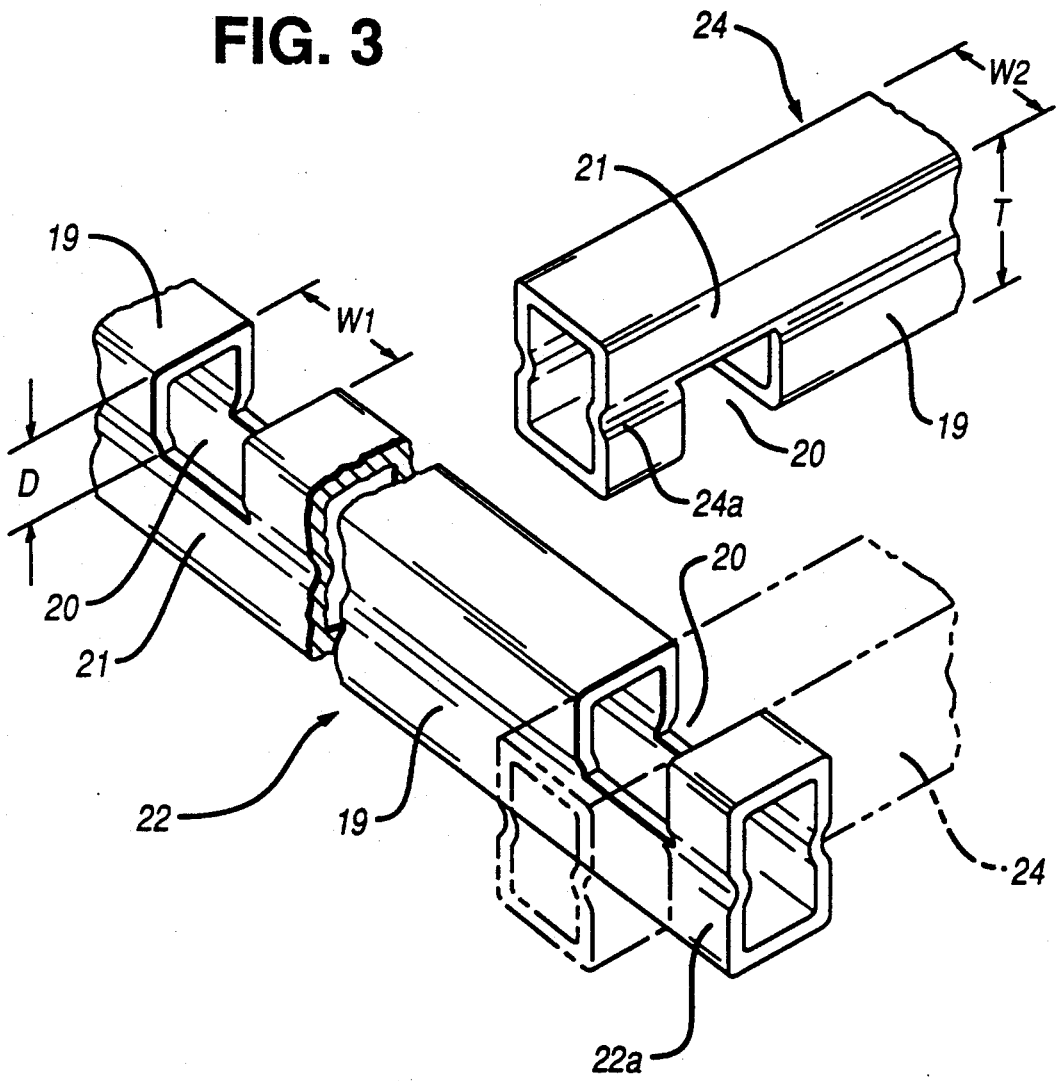
FIG. 3 is a fragmentary perspective view of longitudinal and transverse paper tubes, showing cutouts formed in the tube walls, in particular.

The top and bottom latticeworks 14 and 16 are formed preferably of paper tubes. These paper tubes may have any desired cross section but are preferably of an essentially rectangular cross section as best shown in FIG. 3. A preferred example of the paper tubes used in the present invention is wound paper tubes of a type shown in U.S. Pat. No. 3,648,920 and which are commercially available from Sonoco Prcducts Company of Hartsville, S. C. Such tubes are formed by winding a fiber containing sheet material around a mandrel with the fibers extending predominantly longitudinally of the tube.

Referring to FIGS. 1 and 2, the top latticework 14 is formed of an array of parallel longitudinal paper tubes 22 intersecting an array of parallel transverse paper tubes 24. In like fashion, the bottom latticework 16 is formed of an array of parallel longitudinal paper tubes 26 intersecting an array of parallel transverse paper tubes 28. The top and bottom latticeworks 14 and 16 are of basically the same tube arrangement except that the bottom latticework 16 includes two additional shorter longitudinal tubes 30. One of the shorter tubes 30 extends between the two adjacent transverse tubes 28 on the left hand side as viewed in FIG. 2 whereas the other shorter tube 30 extends between the two adjacent transverse tubes 28 on the right hand side as also viewed in FIG. 2. These shorter tubes 30 are disposed in alignment with each other. In the preferred embodiment, the smaller squares defined at the neighboring corners by those shorter tubes 30 are designed to receive the wheels of a riding lawn mower.

At the intersections of the two arrays of paper tubes, the longitudinal tubes 22 are engaged with the transverse tubes 24 in an interlocking notched fashion. In other words, the longitudinal and transverse tubes 22 and 24, at the intersections, straddle each other by means of U-shaped cutouts 20 formed in the tube walls as illustrated in FIG. 3. Each cutout 20 has a width ($W_1$) generally equal to the width ($W_2$) of the paper tubes and a depth (D) being about a half of the thickness (T) of the paper tubes. Each cutout 20 is defined by a slender portion 21 of the associated paper tube in cooperation with the adjacent thicker portions 19. The cutouts 20 of the longitudinal tubes 22 respectively receive the slender portions 21 of the transverse tubes 24. Stated differently, the slender portions 21 of the longitudinal tubes 22 are mated respectively with the slender portions 21 of the transverse tubes 24 to form the intersections of a full thickness (T) as best shown by the phantom line in FIG. 3. As a result, the upper and lower faces of the longitudinal paper tubes become flush respectively with the upper and lower faces of the transverse paper tubes and thereby the planar opposite sides are formed on the latticework 14. In like manner, the longitudinal tubes 26 of the bottom latticework 16 are engaged with the transverse tubes 28 at their intersections by means of cutouts in their tube walls and form the planar sides on the latticework 16. Each shorter longitudinal tube 30 of the bottom latticework 16 is also engaged with the associated transverse tubes 28 by means of cutouts of the same construction.

Other interlocking arrangements may be employed for the intersections. For example, the transverse tubes 24 may be provided with through holes in their tube walls so as to permit the longitudinal tubes 22 to pass therethrough. In this case, the longitudinal tubes 22 may be provided with shallow cutouts for engaging with the peripheries of the holes in the transverse tubes 24.

Figure 4:
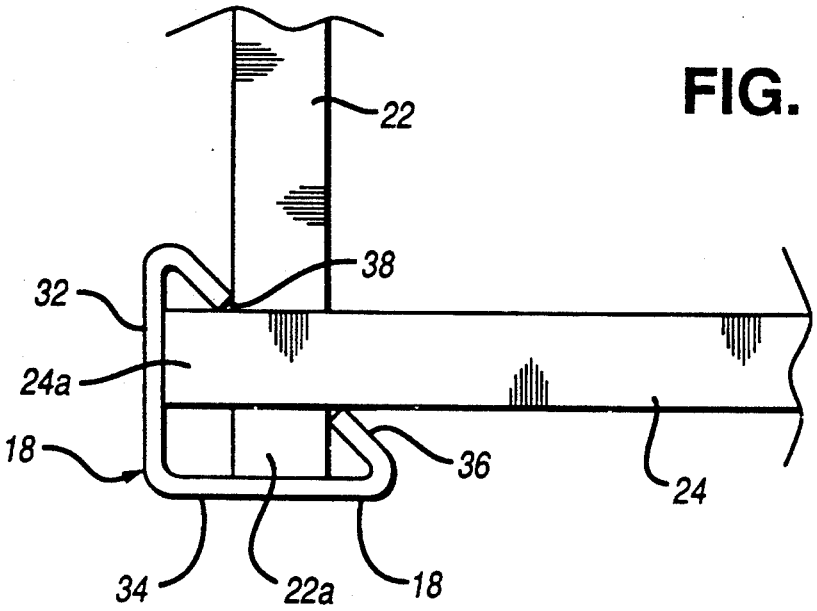
FIG. 4 is a plan view of a joint between a corner post and a top latticework in FIG. 1.

At each corner of the top latticework 14, a longitudinal tube 22 intersects a transverse tube 24 as best shown in FIG. 4. This results in the respective ends **22*a* and 24*a* of the intersecting tubes 22 and 24 projecting laterally from each other's tube walls. These projecting ends 22*a* and 24*a* in combination form a joint portion for engaging with a corner post as will be described later in more detail. The top latticework 14 is provided at its corners respectively with such joint portions. In like fashion, the bottom latticework 16 is provided at its corners respectively with joint portions where each joint portion consists of a pair of ends of two intersecting tubes 26 and 28. These joint portions of the bottom latticework 16 also function as means for engaging with the corner posts 18**.

Figure 5:
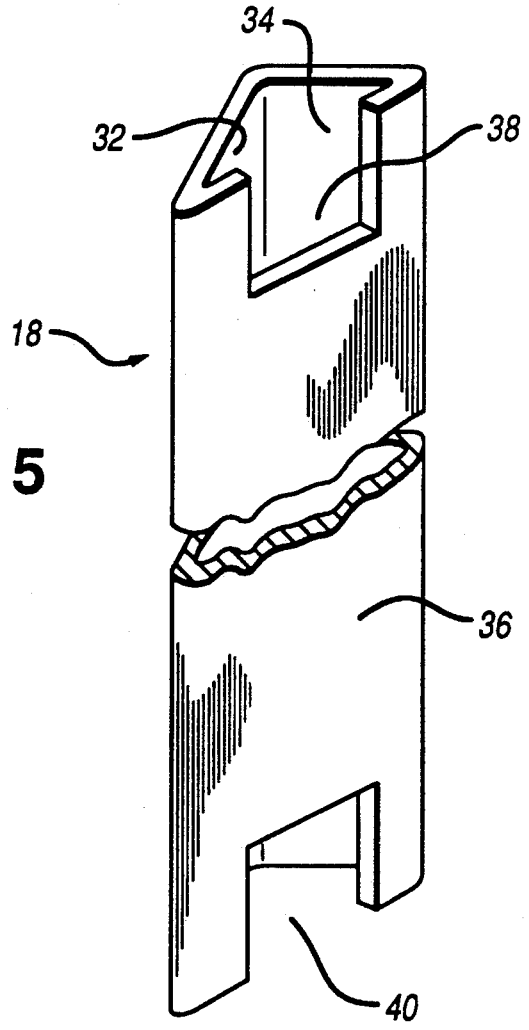
FIG. 5 is a perspective view, partly cut away, of a corner post in FIG. 1.

Referring to FIGS. 4 and 5, each of the corner posts 18 is preferably a paper tube. The corner posts may have any desired cross section but are preferably of a right-angled isosceles triangular cross section as best shown in FIG. 4. A preferred example of the paper corner posts 18 is the same as that for the above-mentioned paper tubes. Such corner posts may be prepared also in a conventional manner.

As best shown in FIG. 5, each corner post 18 has two identical side walls 32 and 34 which define a right angle therebetween and the other wall 36 bridging obliquely between the side walls 32 and 34. U-shaped notches 38 and 40 are respectively formed in those portions of the oblique wall 36 adjacent to the opposite ends thereof. The joint portions of the top latticework 14 are respectively received in the notches 38 and rest on the bottoms of the notches 38. Likewise, the joint portions of the bottom latticework 16 are respectively received in the notches 40 and abut the bottoms of the notches 40. The corner posts 18 thus engaged at their opposite end portions with the top and bottom latticeworks 14 and 16 have their oblique walls 36 facing inwardly of the framework 10 as illustrated in FIG. 4. The joints resulting from the above-mentioned engagement prevent the latticeworks 14 and 16 from moving or shifting toward each other. On the other hand, the same joints permit the latticeworks 14 and 16 to be moved away from each other and to thereby come free of engagement.

It is preferred that each pair of the ends, i.e., each joint portion, are in contact respectively with the internal faces of the side walls 32 and 34 of the associated corner post as shown in FIG. 4. In this arrangement, the latticeworks 14 and 16 effectively prevent the corner posts 18 from moving or shifting inwardly of the container.

The number and arrangement of the paper tubes which comprise the latticeworks and the corner posts depend on the design and structure of an object or article to be packed in the container. It is apparent that the mechanical strength of the container is increased when a greater number of the paper tubes are employed. Also, additional post members may be located between any two neighboring corner posts 18 where the ends of intermediate longitudinal or transverse tubes may be utilized as joint portions.

Turning to the casing 11 and the securing sheets 12 and 13, they may have any desired shape or design that corresponds to the framework 10 and may be made of cardboard, fiberboard or the like, but are preferably made of corrugated fiberboard. A typical example of the fiberboard for the casing and the sheets used in the present invention is double wall fiberboard.

As illustrated in FIG. 1, the top securing sheet 12 is laminated on the upper side of the top latticework 14 by means of glue or the like and, likewise, the bottom securing sheet 13 is laminated on the lower side of the bottom latticework 16 by similar means. It is preferred that all the paper tubes of each latticework are laminated to the associated securing sheet; however, each latticework may be partly laminated to the associated sheet. The top and bottom sheets 12 and 13 are of a shape and size similar to the latticeworks so that each sheet interconnects all the associated paper tubes and holds the associated paper tubes engaged together. Also, the sheets 12 and 13 provide the container with mechanical strength against crushing force acting diagonally of the latticeworks.

The casing 11, as illustrated in FIGS. 1 and 2, includes a tubular portion which consists of a pair of rectangular side panels 44 and 46 and a pair of rectangular end panels 48 and 50. The casing 11 further includes upper and lower sets of cover flaps 60–63 and 64–67. The tubular portion and the cover flaps are preferably formed of a single sheet material.

The end panels 48 and 50 are foldably joined respectively to the side edges of the side panel 44 along the fold lines 52 and 54, and are also foldably joined respectively to the side edges of the side panel 46 along the fold lines 56 and 58. This tubular portion has an axial length generally equal to the length of each corner post. The top and bottom latticeworks 14 and 16 are fitted respectively in the top and bottom opening of the tubular portion. The corner posts 18 are positioned upright respectively at the corners of the tubular portion with their side walls 32 and 34 in direct contact with the corresponding panels of the tubular portion. The framework 10 is confined within the tubular portion, and thus the corner posts 18 are restrained from moving outwardly of the container.

The flap 60 is foldably joined to upper edge of the side panel 44 along the fold line 68 and, likewise, the flap 61 is foldably joined to the upper edge of the side panel 46 along the fold line 70. The flap 62 is foldably joined to the upper edge of the end panel 48 along the fold line 72 and, likewise, the flap 63 is foldably joined to the upper edge of the end panel 50 along the fold line 74. In like fashion, the lower flaps 64, 65, 66 and 67 are foldably joined respectively to the lower edges of the panels 44, 46, 48 and 50 along the fold lines 76, 78, 80 and 82. These cover flaps 60–67, as described later, restrains the upper and lower latticeworks 14 and 16 from moving away from each other and lock the latticeworks 14 and 16 in positions where the latticeworks are engaged with the corner posts 18.

In order to pack a large object in the aforementioned container, the following steps are taken. First, the casing 11 is set up into upright tubular condition. The lower set of the flaps 64–67 are folded inwardly of the casing 11 until the flaps 64–67 are brought into closed position where each flap is substantially perpendicular to the axis of the tubular portion. The bottom latticework 16 with the sheet 13 facing downward is placed at the bottom of the casing 11, and then an object to be packed is lowered onto the bottom latticework 16. Then, the corner posts 18 are placed upright at the corners of the casing 11 while the lower end portions of the corner posts 18 are engaged with the joint portions of the bottom latticework 16, respectively. Because of the engaged lower end portions, the corner posts 18 stand by themselves without any preliminary support. After that, the top latticework 14 with the securing sheet 12 facing upward is inserted in the upper opening of the tubular portion and is placed on top of the corner posts 18. The joint portions of the latticework 14 are engaged with upper end portions of the corner posts 18. The upper set of the flaps 60–63 are then folded inwardly into closed position where each flap is substantially perpendicular to the axis of the tubular portion. Finally, the casing 11 is sealed in any suitable manner as by means of adhesive tape, staples, strapping, glue or the like so that the flaps 60–67 are held in the closed position.

The upper set of flaps 60–63 and the lower set of the flaps 64–67 in closed position form top and bottom walls of the casing 11 respectively, and thus function as means for preventing the latticeworks 14 and 16 from moving away from each other. These flaps need not form complete closures because the securing sheets 12 and 13 cover the upper and lower ends of the tubular portion; however, it is important for the flaps 60–67 to cover and block the openings of the notches 38 and 40 and to thereby prevent the joint portions of the latticeworks 14 and 16 from coming out the notches. Stated differently, the flaps may be of a design and structure such that the flaps cover only the areas around the corners of the top and bottom openings of the tubular portion.

As described above, the latticeworks and the corner posts are not fixedly joined to each another, and the framework 10 is not attached to the casing 11. However, when the casing 11 is in closed condition, it confines the framework 10 within it and restrains the latticeworks and the corner posts from shifting outwardly of the container. Also, the latticeworks and the corner posts prevent each other from moving inwardly of the container so that the internal space for receiving an object is maintained. As a result, the latticeworks and the corner posts are firmly locked in their positions and thus the framework 10 is held in assembled condition.

The structure of the above-mentioned container is particularly useful when containers of this type are stacked on top of one another. The reason is that the corner posts 18 of a relatively large triangular cross section allow easy vertical alignment with the corner posts of other containers. Also, the top and bottom latticeworks 14 and 16 offer high flexural rigidity to the upper and lower portions of the container.

To unpack the container described above, the upper set of the flaps 60–63 are unfolded and then, the top latticework 14 is simply lifted away from the container so as to form an opening through which the contents can be taken out. Alternately, the container may be opened in any desired manner, for example, by cutting the casing wall. Once the casing is opened, the latticeworks and the corner post become separable from one another and therefore it is quick and easy to disassemble the container.

After taking out the contents, the casing 11 can be collapsed into flat condition and the framework 10 can be broken down into flat parts, i.e., the latticeworks 14 and 16, and linear parts, i.e., the corner posts 18.

In order to allow easy disposal or recycling of the container, it is preferred that the whole container including the casing 11 and the framework 10 is made of paper.

Having described the invention in detail and by reference to the preferred embodiments thereof, it will be apparent that modifications and variations are possible without departing from the scope of the invention defined in the appended claims.

What is claimed is:

1. A reinforced container for use in shipping a large object comprising:

a framework defining a space for receiving said object, said framework comprising a bottom latticework for supporting said object, a top latticework disposed substantially parallel to said bottom latticework to define said space between said latticeworks, and a plurality of spaced parallel post members extending and interposed between said latticeworks to maintain said space, each of said top and bottom latticeworks including an array of longitudinal skeleton elements intersecting an array of transverse skeleton elements, each of said latticeworks having at least one planar side, each of said post members including upper and lower end portions having separable engagement means for separably engaging respectively with said top and bottom latticeworks to maintain said post members erected in positions between said latticework;

a covering fitted around said framework, for holding said latticeworks and said post members together in assembled condition; and top and bottom securing sheets laminated respectively onto at least some portion of said planar sides of said top and bottom latticeworks whereby each of said top and bottom sheets interconnects and holds the associated skeleton elements together.

2. The reinforced container according to claim 1, wherein said covering comprises a tubular portion having top and bottom openings, and said top and bottom latticeworks are fitted respectively in said top and bottom openings of said tubular portion.

3. The reinforced container according to claim 2, wherein said separable engagement means of said upper and lower end portions permit said top and bottom latticeworks to shift away from each other so that said latticeworks come free of engagement with said separable engagement means, and said covering further includes locking means for holding said top and bottom latticeworks engaged with said separable engagement means.

4. The reinforced container according to claim 3, wherein said tubular portion of said covering has upper and lower ends, and said locking means comprises top and bottom cover flaps foldably joined respectively to said upper and lower ends of said tubular portion, said top and bottom cover flaps, when folded to closed positions, being disposed respectively over said top and bottom openings.

5. The reinforced container according to claim 3, wherein each of said latticeworks includes a plurality of corners, said corners engaging with the associated ones of said separable engagement means while preventing said post members from shifting at least inwardly of said tubular portion, and said post members are extended along and in contact with an internal surface of said tubular portion whereby said post members are restrained from shifting outwardly of said tubular portion.

6. The reinforced container according to claim 5, wherein said separable engagement means are notches formed in said upper and lower end portions of each of said post members, said notches being open to opposite ends of each post member and receiving associated ones of said corners of said latticeworks.

7. The reinforced container according to claim 1, wherein each of said longitudinal and transverse skeleton elements has slender portions having less thickness than the remainder thereof, each of said slender portions defining a U-shaped cutout in the associated one of said skeleton elements, and said longitudinal and transverse elements, at said intersections, engage with each other in such a manner that said slender portions of said longitudinal elements mate respectively with said slender portions of said transverse elements to form full-thickness intersections whereby each of said top and bottom latticeworks has said planar side.

8. The reinforced container according to claim 1, wherein said longitudinal and transverse skeleton elements are of a tubular configuration.

9. The reinforced container according to claim 8, wherein said skeleton elements are paper tubes, and said covering is made of paper.

10. A reinforcement for placement into a shipping container, comprising:

a plurality of tubular skeleton elements having U-shaped cutouts in respective tube walls thereof and engaged together in an interlocking notched fashion by means of said U-shaped cutouts to form a latticeworks having a planar side; and a securing sheet laminated onto at least some portion of said planar side of said latticework to hold said tubular elements together in engagement.

11. The reinforcement according to claim 1, said tubular elements are paper tubes.

12. The reinforcement according to claim 1, wherein said tubular elements includes an array of longitudinal elements intersecting an array of transverse elements, said longitudinal and transverse elements, at said intersections, engaging each other by means of said U-shaped cutouts.

13. The reinforcement according to claim 12, wherein each of said tubular elements has slender portions which define said U-shaped cutouts, said slender portions having less thickness than the remainder of the associated tubular element, and said longitudinal and transverse elements, at said intersections, engage each other in such a manner that said slender portions of said longitudinal elements mate respectively with said slender portions of said transverse elements to form full-thickness intersections.

14. In a reinforced container for use in shipping a large object including a framework and a covering fitted around said framework, said framework defining a space for receiving said object, said framework including: a bottom latticework for supporting said object; a top latticework disposed substantially parallel to said bottom latticework to define said space between said latticeworks; and a plurality of spaced parallel post members extending and interposed between said latticeworks to maintain said space, the improvement wherein each of said top and bottom latticeworks comprises:

a plurality of tubular skeleton elements having U-shaped cutouts in respective tube walls thereof and engaged together in an interlocking notched fashion by means by said U-shaped cutouts to form a lattice structure having a planar side; and a securing sheet laminated onto at least some portion of said planar side of said lattice structure to hold said tubular elements together in engagement.

15. The reinforced container according to claim 14, wherein said post members are tubular in shape.

16. The reinforced container according to claim 14, said tubular elements and post members are paper tubes, and said covering is made of paper.

17. The reinforced container according to claim 14, wherein said tubular skeleton elements includes an array of longitudinal elements intersecting an array of transverse elements, said longitudinal and transverse elements, at said intersections, engaging each other by means of said U-shaped cutouts.

18. The reinforced container according to claim 17, wherein each of said latticeworks has a plurality of corners, each corner being defined by two associated tubular elements intersecting each other at the corresponding corner, each of said latticeworks further comprises a plurality of joint portions disposed respectively at said corners to engage said post members, each of said joint portions comprising respective ends of said two associated tubular elements projecting laterally from each other's tube walls, each of said post members is provided at upper and lower end portions thereof with notches, said notches being open to opposite ends of the corresponding post member, and said joint portions of said top latticework are received respectively in said notches at said upper end portions of said post members whereas said joint portions of said bottom latticework are received respectively in said notches at said lower end portions of said post members.

19. The reinforced container according to claim 17, wherein each of said tubular elements has slender portions having less thickness than the remainder of the associated tubular element, said slender portions defining said U-shaped cutouts, said longitudinal and transverse elements, at said intersections, engage each other in such a manner that said slender portions of said longitudinal elements mate respectively with said slender portions of said transverse elements to form full-thickness intersections.

* * * * *

UNITED STATES PATENT AND TRADEMARK OFFICE

CERTIFICATE OF CORRECTION

PATENT NO. : 5,143,283

DATED : September 1, 1992

INVENTOR(S) : Gary D. Lancaster

It is certified that error appears in the above-identified patent and that said Letters Patent is hereby corrected as shown below:

Column 7, line 51, "latticework" should read --latticeworks--;

Column 8, line 53, "latticeworks" should read --latticework--;

Column 8, line 57, "claim 1" should read --claim 10--;

Column 8, line 59, "claim 1" should read --claim 10--;

Column 9, line 21, "by means by" should read --by means of--.

Signed and Sealed this

Twenty-third Day of November, 1993

*Attest:*

Bruce Lehman

BRUCE LEHMAN

*Attesting Officer*

*Commissioner of Patents and Trademarks*